US006468189B2

(12) United States Patent
Alessandri

(10) Patent No.: US 6,468,189 B2
(45) Date of Patent: Oct. 22, 2002

(54) EXERCISE MACHINE

(75) Inventor: Nerio Alessandri, Longiano (IT)

(73) Assignee: Technogym S.r.l., Gambettola (IT)

( * ) Notice: Subject to any disclaimer, the term of this patent is extended or adjusted under 35 U.S.C. 154(b) by 0 days.

(21) Appl. No.: 09/779,580

(22) Filed: Feb. 9, 2001

(65) Prior Publication Data

US 2001/0014641 A1 Aug. 16, 2001

(30) Foreign Application Priority Data

Feb. 11, 2000 (IT) ..... BO2000A 000059

(51) Int. Cl.[7] ..... A63B 21/00
(52) U.S. Cl. ..... 482/99; 482/98; 482/100
(58) Field of Search ..... 482/99, 98–103, 482/5, 133–137

(56) References Cited

U.S. PATENT DOCUMENTS 4,610,449 A * 9/1986 Diercks, Jr. ..... 482/102
4,627,615 A * 12/1986 Nurkowski ..... 482/102
5,037,089 A * 8/1991 Spagnuolo et al. ..... 482/102
5,306,221 A 4/1994 Itaru
5,350,344 A * 9/1994 Kissel ..... 482/98
5,643,151 A 7/1997 Naimo
5,776,040 A * 7/1998 Webb et al. ..... 482/98

FOREIGN PATENT DOCUMENTS

| | | |
|---|---|---|
| DE | 91 10 785 U | 11/1991 |
| EP | 0 943 358 A2 | 9/1999 |
| SE | 459 156 B | 6/1989 |

* cited by examiner

*Primary Examiner*—Jerome W. Donnelly
(74) *Attorney, Agent, or Firm*—Arent Fox Kintner Plotkin & Kahn, PLLC

(57) ABSTRACT

An exercise machine, having a frame that supports a gravitational load set; the load set comprising at least a first body of determined mass movable vertically and at least a first guiding element associated to the first body; the load set comprising at least an additional guillotine load unit, selectable at will.

14 Claims, 5 Drawing Sheets

EXERCISE MACHINE

BACKGROUND OF THE INVENTION

The present invention relates to a counterweight exercise machine, usable to exercise determined muscle districts in eccentric and, alternatively, concentric fashion for purposes of muscle strengthening and/or rehabilitation.

In the field of counterweight exercise machines, the operation of a tool to obtain the lifting of a load through a mechanical transmission is known. Naturally, the load, the tool and the transmission are supported by a frame.

The load set comprises a plurality of weights of determined mass, free to slide on a pair of vertical rods. Each rod is supported by the frame, and engages a guiding hole obtained in the weights themselves, which are mutually stacked at rest, to define a so-called weight pack.

Naturally, the load must be proportioned based on user'specific requirements, so counterweight machines are provided with a load selector device. Such a device comprises an elongated organ which, in resting conditions, is positioned facing all the weights. The elongated organ presents a plurality of transverse holes, each of which faces and is coaxial to a corresponding weight, also transversely holed. The set of two coaxial holes, obtained in the elongated organ and in each of the weights defines a channel able to house a selection pin, which effects the mutual connection between a determined weight and the elongated organ. By lifting the elongated organ, one thereby obtains the lifting of the selected weight, and of all weights positioned above the selected one, to define a so-called weight pack.

Normally, the weights of the weight pack are all equal, but counterweight exercise machines for rehabilitation may have a set of weights of determined mass on a set of weights of greater mass.

The better to graduate the load increase, an additional mass, lesser than the weights of reduced mass, is usually employed. Such additional mass is positioned above the first weight, and is so shaped as to have a coupling surface matched to the weight. After completion of the exercise, the additional mass is stored on a support that is integral with the frame, wherefrom it is drawn for the successive use.

Machines with load sets with additional mass like the one described above have some drawbacks. In particular, considering that such machines are normally employed in public spaces, such as gymnasiums or rehabilitation centers, the support of the additional mass applied to the frame can constitute an obstacle for the movements of the users who transit near the machine, or who approach the machine for the training session. Moreover, an improper positioning of the additional mass on the first weight, or a sudden release of the tool, can cause the immediate fall of the load. Such a fall can have consequences that are difficult to predict, whether impact occurs against the floor of the gymnasium or against a base portion of the machine itself. Naturally, if the impact is absorbed by the user, the owner of the gymnasium where the machine is located would be liable for any injuries suffered by the user.

SUMMARY OF THE INVENTION

The aim of the present invention is to provide an exercise machine that is free from the drawbacks described above.

According to the present invention, an exercise machine is provided in which a frame supports a gravitational load set comprising at least a first body of determined mass, movable vertically, and first means for guiding said first body in said direction; wherein said load set comprises at least an additional guillotine load set, selectable at will.

BRIEF DESCRIPTION OF THE DRAWINGS

The invention shall now be described with reference to the accompanying drawings, which illustrate some non limiting embodiment examples, in which.

DESCRIPTION OF THE PREFERRED EMBODIMENTS

Figure 1:
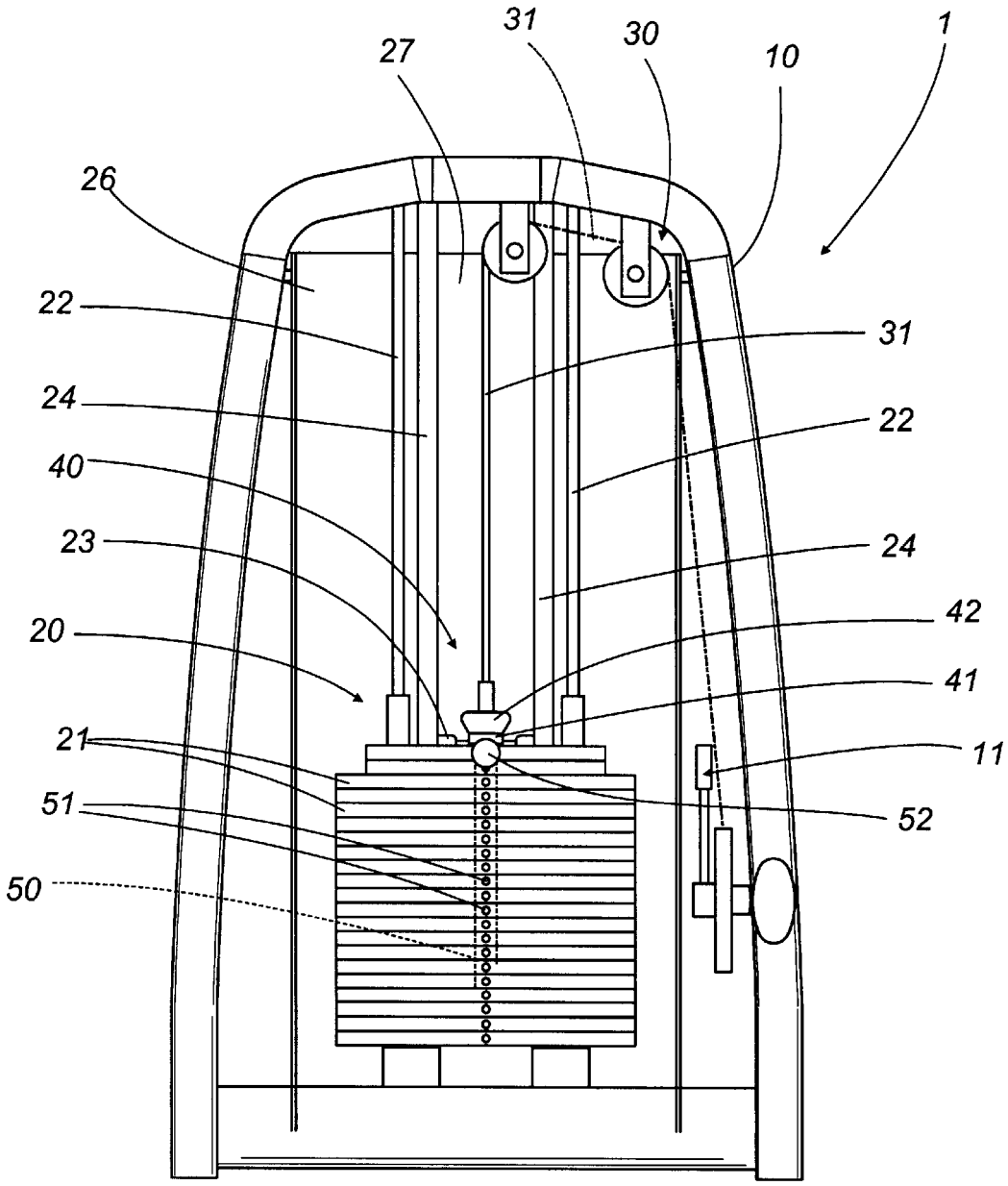
FIG. 1 is a schematic perspective view of a preferred embodiment of an exercise machine according to the present invention.

In FIG. 1, the reference number 1 globally indicates an exercise machine usable for training and/or rehabilitation activities.

The machine, purposely shown schematically in FIG. 1, comprises a frame 10 that supports a gravitational load set 20. The frame 10 also supports a tool 11 which can be operated by a user for training purposes, and a pulley transmission 30 that connects the set 20 and the tool 11, to allow the selective operation of the load set by the user by means of the tool 11 itself. For a better understanding of the tool concept, one can think of a lever pivotally engaged to the frame, a bar connected to the load set 20 through a cable, or the like.

Figure 2:
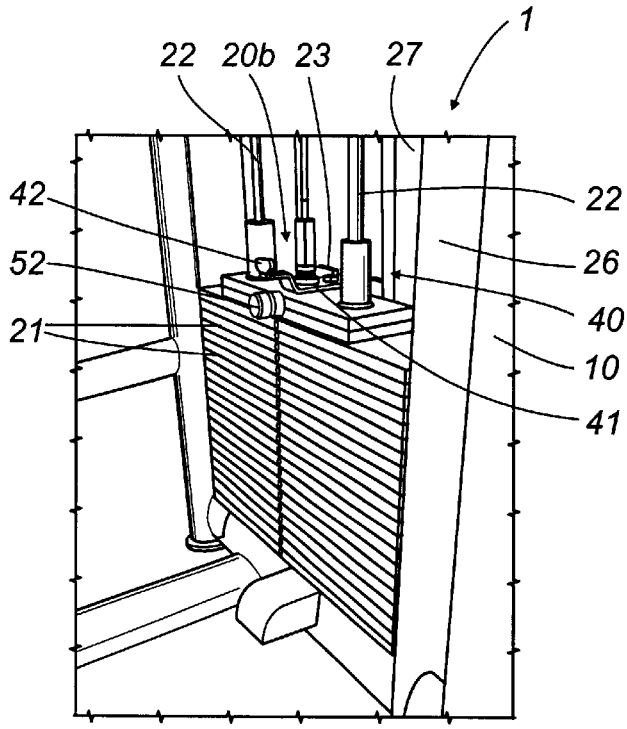
FIG. 2 is a schematic perspective view, in enlarged scale and with some parts removed for the sake of clarity, of the machine of FIG. 1.

The set 20 comprises at least a prismatic body 21 of determined mass, able to be actuated with rectilinear motion along at least a guiding organ extending in the vertical direction. With particular reference to FIG. 2, the set 20 has a plurality of bodies 21 substantially identical to each other, each of which has substantially prismatic shape and determined mass and, here and hereafter, shall be identified with the term weight 21. The guiding organ is normally doubled the better to guide the weights 21 in the alternating vertical motion, and it is obtained by means of a rod 22 made of metallic material, kept vertical by the frame 10.

The load set 20 further comprises another prismatic body 23, also of determined mass, and able to be selectively actuated vertically in association with the tool 11. Said prismatic body 23 is normally embodied by a rectangular plate of reduced thickness, which is positioned posteriorly to the weights 21, and is coupled to a vertical guidance element 24 distinct from the rods 22, and rigidly connected to the frame 10. Hence, the plate 23 is movable independently from the weights 21.

Figure 4:
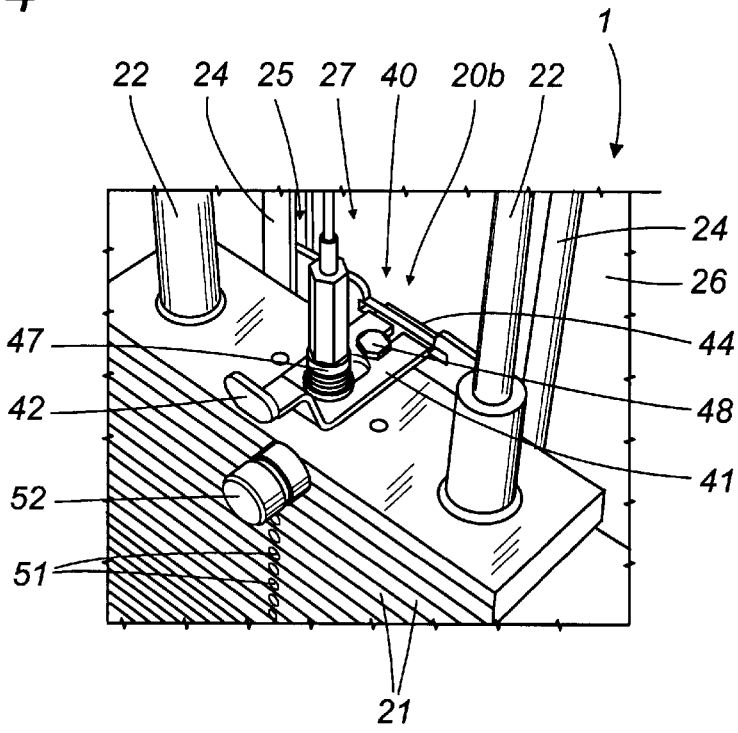
FIG. 4 is a perspective view, in enlarged scale and with parts removed for the sake of clarity, of the machine of FIG. 1 in a second condition of operation.

According to FIG. 4, the element 24 is a guide of the rectilinear motion, obtained through a vertical bar 24, whose section is delimited by a "C" shaped profile, in such a way as to have a longitudinal seat 25 able to house in sliding fashion a lateral edge of the plate 23 itself.

Also with reference to FIG. 4, on the machine 1 are provided two bars 24 substantially identical to each other, one for each of the two vertical edges of the plate 23 itself. In accordance with the above description, the plate 23 is kept bilaterally guided by the complex constituted by the two bars 24. The two bars are supported by the frame 10 through a protecting organ, or case 26, which is fastened to the frame 10 in a rigid and selectively releasable manner. Said case 26 closes at least posteriorly access to the load set 20 to prevent users from penetrating into the area traversed by the weights 21 and by the plate 23, for safety reasons. It is appropriate to note that the case 26 has a recessed portion 27 obtained by forming, and delimited by two longitudinal edges of reduced thickness (known and not shown), which stiffen the case 26 itself. Moreover, each longitudinal edge (known and not shown) houses a bar 24, so that the case 26 can be considered a support organ for the two bars 24.

The load set 20 has a latching device 40 borne by the upper weight 21. Said device 40 allows mutually to connect the plate 23 and the first weight 21. In particular, the device 40 comprises a selector organ 41, elongated according to the transverse direction to the rods 22 and to the plate 23. Said selector organ 41 terminates anteriorly with an end portion 42 which is "Z" shaped so as to define a handle. The organ 41 has, at the side opposite the handle 42, a spoon-shaped portion 44 whose longitudinal extension approximates, exceeding it, the thickness of the plate 23, in such a way as to be able to latch it stably. In this regard, the plate 23 superiorly presents a slit 45 which faces the spoon-shaped portion 44, and is able to house it. According to the description above, the organ 41 can be obtained by bending punched sheet metal.

The device 40 further comprises a device a device for guiding the motion of the organ 41 in the direction transverse to the rods 22 from and to an engagement position of the plate 23. See FIGS. 4 and 3 for the engaged and, respectively, disengaged positions of the slit 45. Said device 40 comprises a pair of pivots 47 and 48, each extending upwards from an upper face of the top weight 21 parallel to the plate 23. The pivot 47 is positioned at the center of the upper face of the first weight 21, whilst the pivot 48 is positioned in correspondence with a rear lateral edge of the weight 21 in question.

Figure 3:
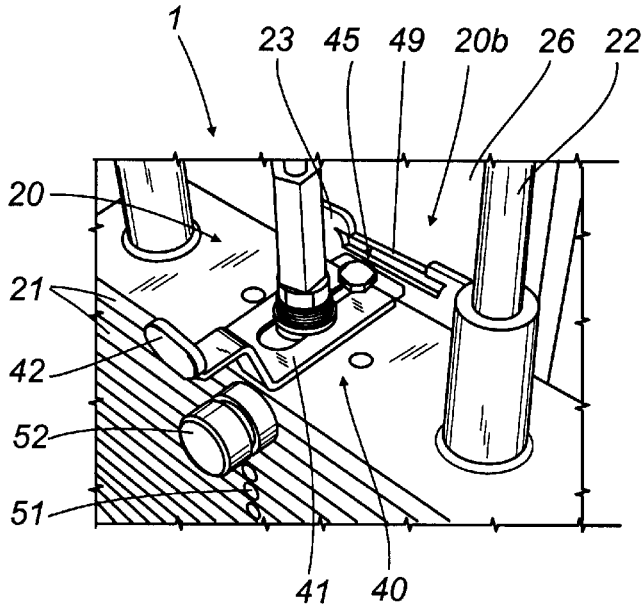
FIG. 3 is a perspective view, in enlarged scale and with parts removed for the sake of clarity, of the machine of FIG. 1 in a first condition of operation.
Figure 5:
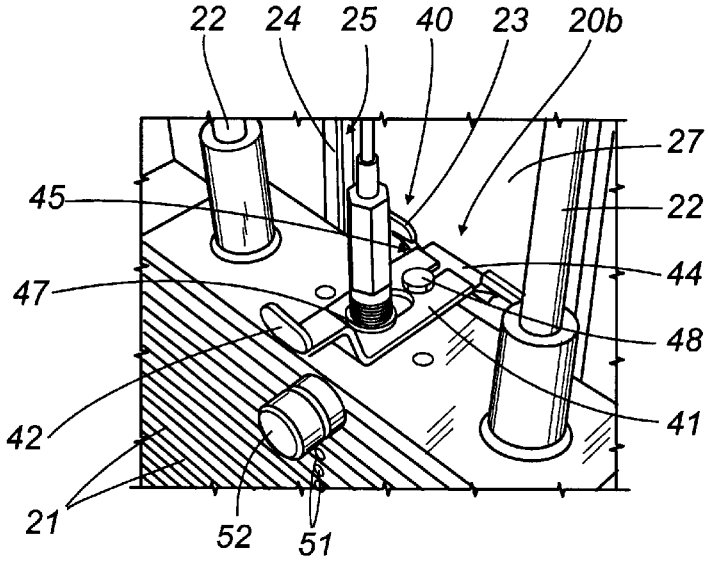
FIG. 5 is a perspective view, in enlarged scale and with parts removed for the sake of clarity, of the machine of FIG. 1 in a third condition of operation.

With particular reference to FIG. 3, the device 40 comprises at least an elastically yielding organ which, in this case, but without limiting in any way the generality of the present concept, comprises an elastic lamina 49 that closes superiorly the slit 45. The lamina 49 is delimited by respective end portions held stably in position in correspondence with two lateral edges of the slit 45 itself. The elasticity allows the lamina 49 to yield under the sudden action of a transverse load. See for instance FIG. 5, where the load given by the weight pack alone is transmitted to the lamina 49 by the organ 41 situated vertically facing the deselected plate 23. As can be seen, the lamina 49 has yielded elastically and the plate 23 has not suffered any damages.

On the contrary, if the slit 45 were delimited by a horizontal segment obtained in a single piece, even admitting to the ability of the plate 23 to withstand high transverse stresses exerted, for instance, by the fall of a weight pack, the bending of the organ 41 or the breakage of the respective spoon-shaped portion 44 would be risked.

As is the case in most exercise machines, the load set 20 comprises an elongated organ that faces the weights 21 and is able to select the number of weights 21 that are to be included in the training load. Said elongated organ comprises a rod 50 provided with a plurality of transverse through holes, known and not shown, which are distributed over the length of the rod 50 itself. The number of known and not shown transverse holes equals the number of the weights 21, and each weight 21 has a respective transverse hole 51 coaxial to the hole of the rod 50. The set 20 further comprises a connecting pin 52 able to be housed in any pair of holes of the rod 50 and of the respective weight 21 to connect them stably. Said pin 52 serves as a support for the respective weight 21, and the latter defines a support base for all weights 21 positioned superiorly. Therefore the weight 21 traversed by the pin 52, simultaneously, makes the weights 21, positioned superiorly to the selected weight 21, integral with the rod 50. It should be specified that the pivot 47 is coaxial to the rod 50, and is integrally connected thereto.

The transmission 30 comprises a plurality of transmission pulleys and a cable 31 (visible in FIG. 1 and partially in FIG. 4) wound on said pulleys to connect the tool 11 to the rod 50, and hence to the load, in a known manner. In particular, said cable 31 is connected to the pivot 47 through a threaded terminal, which allows the adjustment of the unloaded tension of the cable 31 itself.

It should be noted that, to allow for a better graduation of the weight pack, the first 4–5 weights 21 have a lesser mass than that of the underlying weights, since, for low selected loads, users are more sensitive to mass increases.

Naturally, the distance between the holes of the rod 50 is the thickness of the weights 21. Thus, if the thickness of the weights 21 is uniform, the distribution of the holes will also be uniform, and vice versa.

The use of the machine 1 is easily understandable from the description provided above, and requires no further explanation.

However, it is important to specify that, because of the features described above, the machine 1 makes available to the user a gravitational mass load that is adjustable at will; the minimum load available with the plate 23 selected approximates, exceeding it, the mass of the first weight 21 and of the plate 23, since the organ 41 is borne by the first weight 21, together with the pivots 47 and 48; the masses (weights 21 and plate 23), selectable by means of the organ 41 and, respectively, the pin 52, are always within the machine 1 and constantly in a position protected by the case 26. It is therefore impossible to cause accidental injuries to the users who transit carelessly behind the machine 1, even when it is operated by a user. Naturally, accidents in the front position can be prevented simply by increasing the surface area of the case also in the front position.

The choice of obtaining an additional mass by means of the planar plate 23, and of employing the lamina 49 to close superiorly the slit 45 provides the slit 45 itself with accessibility from above. Thence, with the plate 23 in the resting position and the organ 41 in the extracted position, vertically facing the plate 23, the load can be release in a fully safe manner. Even in case of uncontrolled release of the load, the organ 41 will be able to return to the height corresponding to the respective rest position facing the plate 23 without any impacts with the plate 23 itself. On the contrary, at the end of its fall towards the respective rest height, the organ 41 will engage the slit 45 entering from above and the only result will be the deformation of the lamina 49.

In accordance with the above description, the plate 23, the bars 24 and the organ 41 globally define a guillotine load unit 20*b*, selectable at will and able to be operated by means of the rod 50 and hence by means of the tool 11 when an additional load of reduced size relative to the mass of a further weight 21 is required.

Lastly, it is clear that the machine 1 described and illustrated herein can be subject to modifications and variations without thereby departing from the protective scope of the present invention.

Figure 6A:
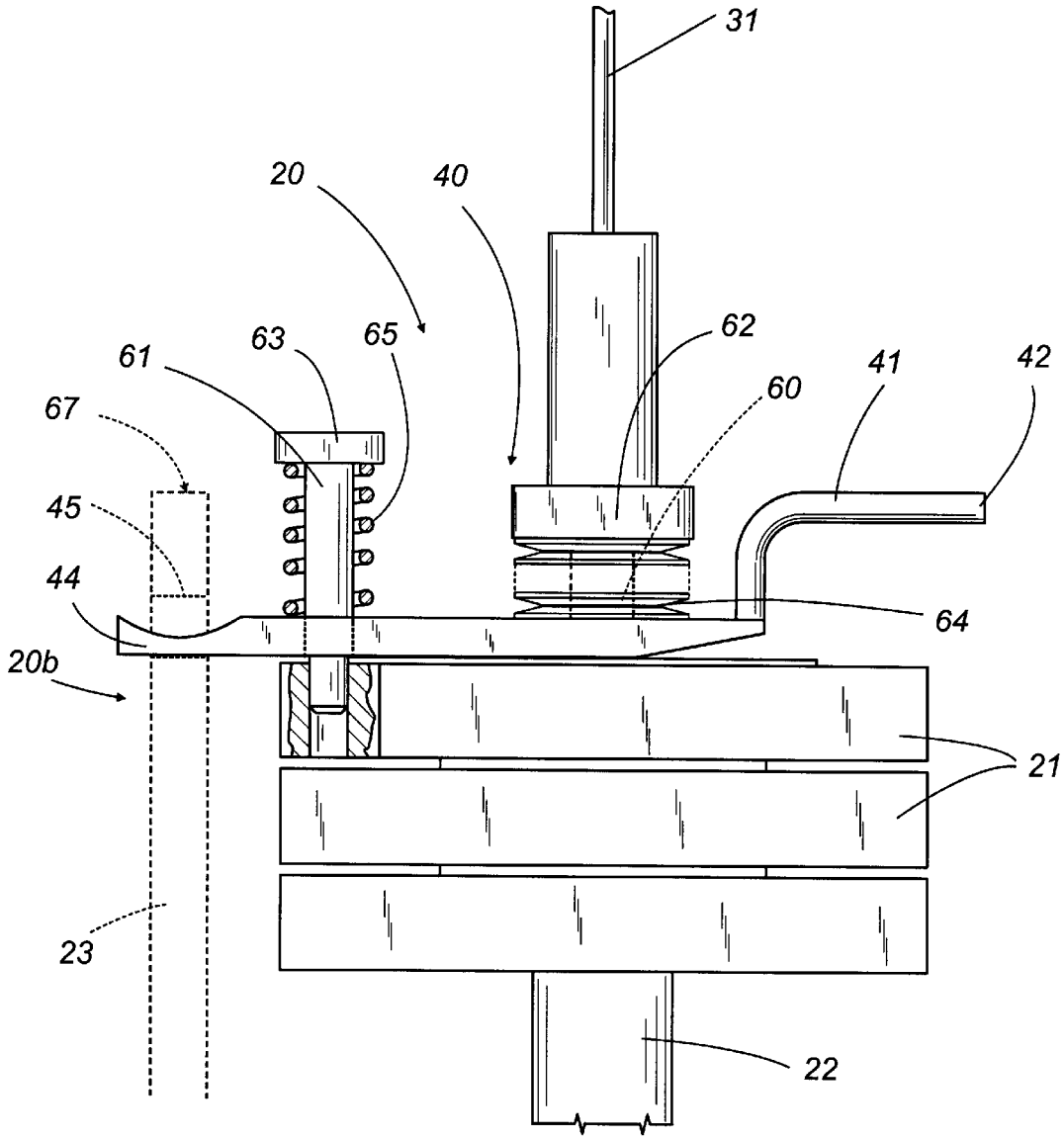
FIG. 6 is a schematic view, in side elevation with some parts eliminated for the sake of clarity, of a second preferred embodiment of the present invention in two successive conditions of operation.
Figure 6B:
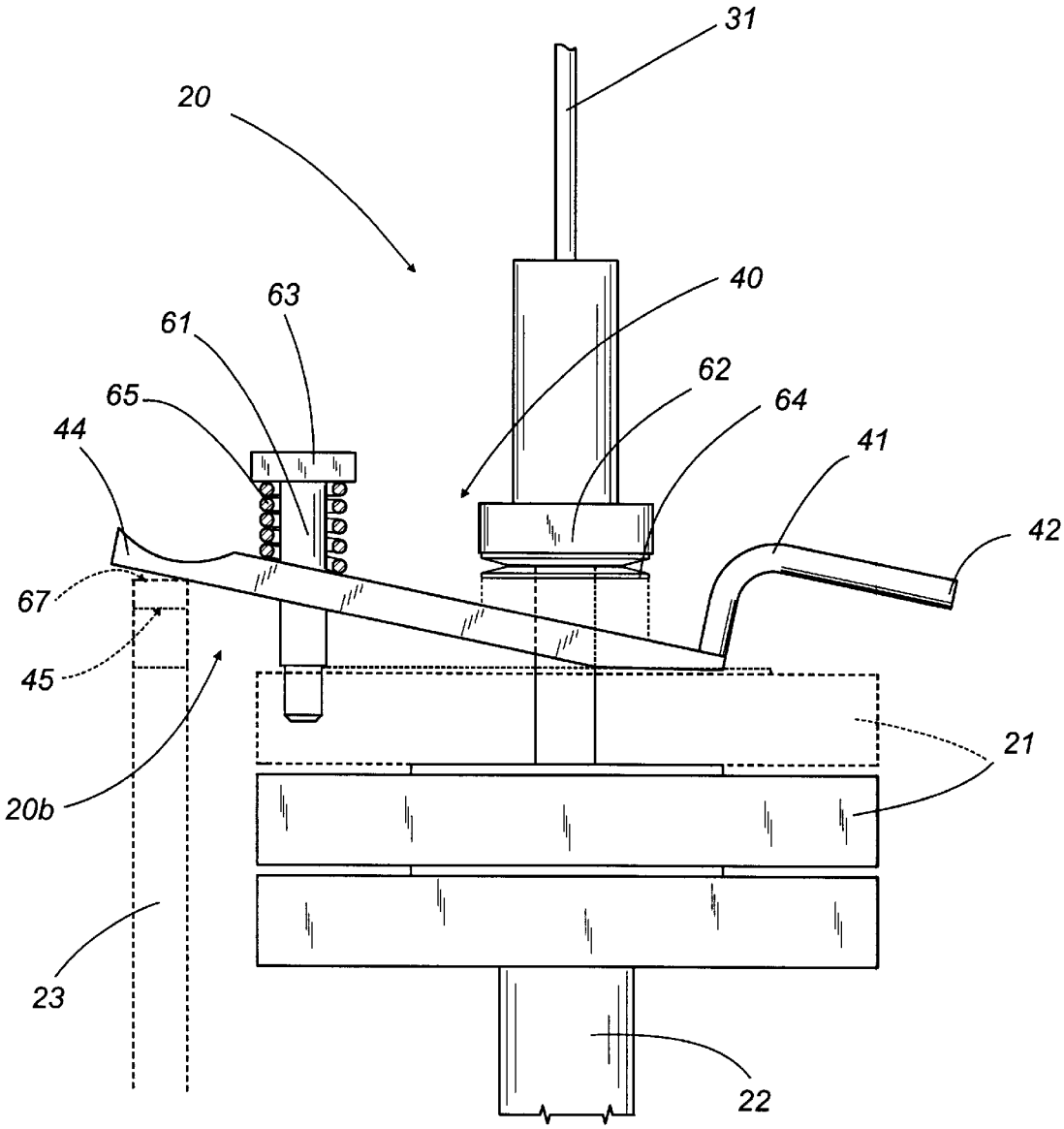

For instance, with reference to FIGS. 6*a* and 6*b*, the pivots 47, 48 already illustrated in FIGS. 2 and 3 are replaced by pivots 60 and 61, each of which has an annular abutment 62, 63, transverse to the longitudinal axis of the respective pivot. The latching device 40 in this case comprises a pair of elastically yielding organs, in particular a Belleville washer 64 and a helical torsion spring 65. The washer 64 and the spring 65 are associated to the respective pivot 60, 61, and are positioned between the first weight 21 and the corresponding abutment 62, 63 to thrust the organ 41 against an upper face 66 of the first weight 21, which to simplify its representation is shown with dashed lines.

It should be noted that the abutment 63 is positioned on the side of the slit 45 and, like the abutment 62, its distance from the face 66 approximates, exceeding it, the distance of the slit 45 from a face 67, which superiorly delimits the plate 23, shown in FIG. 6 with dashed lines.

Because of the features described above, the organ 41 is allowed to rotate/move freely subsequent to a sudden impact of the organ 41 itself with the face 66 of the first weight 21, but also to a simple contact between the parts. Such rotations/movements are found necessary in case of an uncontrolled release of the load under conditions in which the organ 41 is in the extracted position and the plate 23 is deselected. To clarify further, when, in use, the organ 41 contacts the face 67 of the plate 23 (FIG. 6*b*), the spring 65 is forced to yield by the action of the face 67, and it allows the organ 41 to rotate freely relative to the first weight 21. Naturally, the spring 64 is also loaded as a result of such a rotation, allowing the organ 41 to deviate from the respective extracted position to extended contact with the weight 21. If this did not occur, the organ 41 would react to the impact against the face 67 by bending or breaking, and the portion of plate 23 that delimits superiorly the slit 45 could react in the same way.

To improve the operating conditions of the organ 41, the device 40 further comprises a lamina 68 made of material having low friction coefficient, which is rigidly connected to the first weight 21, in a position underlying the organ 41 itself. The lamina 68 facilitates the sliding of the organ 41 itself in the motion from and to the engagement of the slit 45, in order to preserve the quality of the surface of the face 52 over time.

The invention thus conceived can be subject to numerous modifications and variations, without thereby departing from the scope of the inventive concept. Moreover, all components can be replaced by technically equivalent elements.

What is claimed is:

1. An exercise machine having a frame that supports a gravitational load set comprising:

at least a first body of determined mass, movable in the vertical direction and first means for guiding said first body in said direction;

at least an additional guillotine load unit, selectable at will and presenting a second body of determined mass, movable in said direction, and second means for guiding said second body in said direction;

said load set presenting latching means able to render integral said first and second body, in such a way as to make available a gravitational load of determined and adjustable mass, said gravitational load approximating, and exceeding, the sum of the masses of said first and second body; said latching means comprise a selector organ movable in a determined direction relative to said second body to engage transversely the second body itself, and safety means able to safeguard the integrity of said second body and selector organ;

wherein said selector organ is borne, able to slide, by said first body and is able to engage transversely the second body itself with a respective end portion, to render said first and second body selectively integral with each other in the vertical motion along the respective first and second guiding means; the safety means being elastically yielding to safeguard the integrity of said selector organ and of said second body following a sudden impact of the selector organ with the first body.

2. A machine as claimed in claim 1, wherein said second guiding means comprise two guiding organs positioned to the side of said body; said second body being supported by the frame and coupled to said guiding organs in such a manner as to slide freely in said vertical direction.

3. A machine as claimed in claim 2, further comprising a planar plate, said plate presenting superiorly a slit substantially facing said selector organ; said slit presenting a transverse extension that approximates, exceeding it, the transverse extension of said selector organ, in such a way that the selector organ can be freely housed within the slit itself.

4. A machine as claimed in claim 3, wherein said latching means comprise a first and a second pivots borne superiorly by said first body; said first and second pivots being parallel to said plate and mutually aligned to identify a direction that is transverse to said plate; said selector organ being coupled to said pivots in such a manner as to be free to slide from and to a position of engagement of said slit.

5. A machine as claimed in claim 4, wherein said safety means comprise, for each said pivot, a transverse abutting organ and an elastic organ positioned between said first body and the corresponding abutting organ, to maintain said selector organ in contact with an upper face of said first body.

6. A machine as claimed in claim 5, wherein each abutting organ is separated from the upper face of said first body by a length that approximates, exceeding it, the distance between said slit and a second upper face of said plate, in such a way as to allow said selector organ to rotate/move freely following a sudden impact of said selector organ with said upper face; said movements being more extensive than said distance between said slit and said second face of said plate.

7. A machine as claimed in claim 4, wherein said safety means comprise a thin lamina that superiorly closes said slit, and is able to yield elastically following a sudden impact of said selector organ according to a vertical direction, and to allow the free entry of said selector organ into said slit.

8. A machine as claimed in either of the claim 3 or 6, wherein said load set comprises a plurality of third bodies of determined mass; said third bodies being stacked together above a base of said frame, and below said first body; said third bodies being able to slid freely along said first guiding means.

9. A machine as claimed in claim 8, wherein said load set comprises an elongated organ facing said first and third prismatic bodies and able to be actuated vertically, and at least a mechanical element able to connect said elongated organ with at least one of said first and third prismatic bodies to give rise to a mass of determined size able to be actuated from and to a respective rest position.

10. A machine as claimed in claim 9, wherein said elongated organ is integral with said first body.

11. A machine as claimed in any of claims 2 to 7, wherein each of said guiding organs comprises an elongated prismatic element, presenting a substantially "C" shaped seat, able to house in sliding fashion a longitudinal end portion of said second body.

12. A machine as claimed in claim 11, comprising at least a protection organ supported by said frame, to prevent access to said load set; said protection organ supporting a pair of prismatic elements positioned facing each other to guide said second body in movements according to the vertical direction.

13. A machine as claimed in claim 12, wherein said first guiding means comprise at least a vertical rod borne by said whereon said first and third prismatic body are mounted in such a way as to slide freely.

14. A machine as claimed in claim 13, wherein each of said first and third bodies has a respective horizontal hole, facing a respective second horizontal hole obtained in said elongated organ; said mechanical element comprising a connecting pin able to be housed in said first and second holes respectively facing each other, in such a way as to connect rigidly the corresponding first/third body with said elongated organ.

* * * * *